United States Patent [19]

Moreira

[11] 4,259,998

[45] Apr. 7, 1981

[54] LOOM WITH STATIONARY WEFT SUPPLY

[76] Inventor: Manuel E. Moreira, 830 Langley St., Fall River, Mass. 02720

[21] Appl. No.: 48,244

[22] Filed: Jun. 13, 1979

[51] Int. Cl.[3] ..... D03D 47/38

[52] U.S. Cl. ..... 139/450; 139/453; 139/430

[58] Field of Search ..... 139/194, 429, 450, 453

[56] References Cited

U.S. PATENT DOCUMENTS 4,040,452 8/1977 Santucci ..... 139/429

FOREIGN PATENT DOCUMENTS 2509664 9/1976 Fed. Rep. of Germany ..... 139/453

*Primary Examiner*—Henry Jaudon

*Attorney, Agent, or Firm*—Barlow & Barlow, Ltd.

[57] ABSTRACT

A shuttleless loom having a multiple weft supply and weft selection mechanism including a plurality of selector arms is provided with a weft holding device which holds all wefts adjacent one edge of the warps. Means are provided to move a selected weft from the fell of the fabric to the shed position where it may be engaged by a hook and pulled through the shed.

6 Claims, 3 Drawing Figures

LOOM WITH STATIONARY WEFT SUPPLY

BACKGROUND OF THE INVENTION

Fabrics are woven in different kinds of looms, one of which concerning this invention is a shuttleless type, for example, a rapier or needle loom in which the weft from a stationary supply is drawn through the shed of the warps to position the weft for beatup by the reed. In many looms of this type a false selvage is woven along a side of the fabric in order to hold wefts from a stationary weft supply in position, this false selvage then being severed from the edge of the fabric and discarded. Different selecting means may be provided for a plurality of wefts and a pattern operated in a jacquard fashion may be used to provide the selection of wefts desired, such as shown in U.S. Pat. Nos. 1,762,377 and 3,548,886.

SUMMARY OF THE INVENTION

A shuttleless loom of the above mentioned type is provided in which a false selvage at one edge of the fabric is unnecessary, a friction holding device being used in place of the false discarded selvage. Also there are a plurality of stationary weft supplies any one of which may be selected and positioned in the path of the device that may be a rapier and drawn through the shed of the warps. On being beat up by the reed to the fell of the cloth, this beatup weft is positioned in the friction holding device and then severed, positioning the weft so that it may be again selected in its desired sequence according to the pattern of the fabric.

DESCRIPTION OF THE PREFERRED EMBODIMENT

Figure 1:
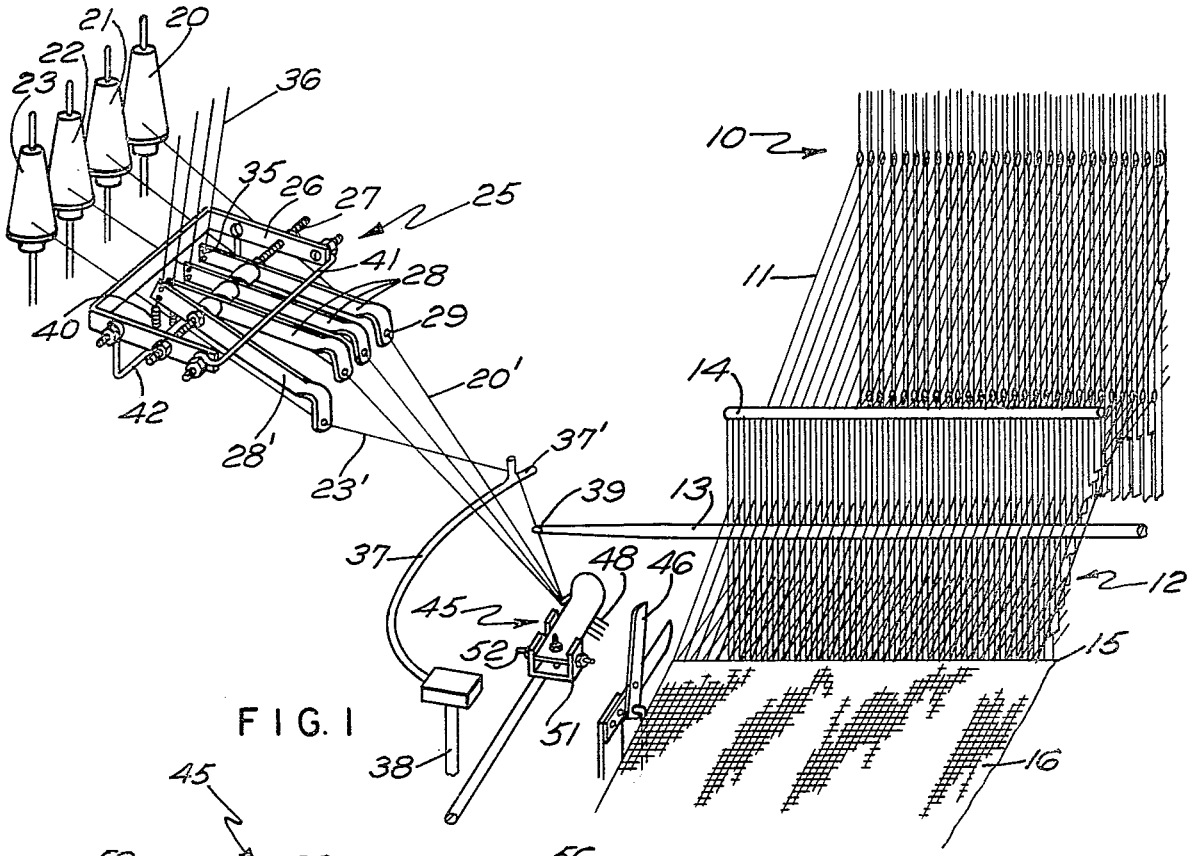
FIG. 1 is a diagrammatic view illustrating the various parts of the loom which come into action with this invention.

Referring particularly to FIG. 1 where for illustrative purposes a rapier loom is shown, harnesses designated 10 have warps 11 extending through eyes in the harnesses for raising or lowering the warps in order to provide a shed 12 through which a rapier 13 passes for positioning the weft threads through the shed of the warps. A reed 14 serves to beat up the inserted weft thread to the fell 15 of the fabric 16.

Dissimilar weft supplies are shown at 20, 21, 22 and 23, anyone of which may be selected to be positioned by the rapier 13 through the shed of the warp. The selector mechanism is designated generally 25 and consists of a frame 26 shown as generally U-shape in a horizontal position with a pivoting rod 27 extending between the legs of the U and with a plurality of arms 28 pivoted on this rod 27 and with wefts extending through eyes 29 of each of the arms from the various weft supplies 20, 21, 22 and 23. At the opposite end of the arms 28 there are connections 35 to cords 36 with these different cords extending to a jacquard type of motion controlled by a jacquard belt or the like so that the weft desired to be inserted may be selected by pulling cord 36 upwardly as shown in FIG. 1 which causes the arm 28 to swing about the pivot rod 27 to a downward position such as shown by the arm 28'. This so positions the weft from its supply package, which here is shown as 23 that this weft 23' moves downwardly into a fork end 37' of a swinging finger 37 swung by means of the rotation about the axis of a shaft 38 to position this weft in the path of the rapier 13 so that the hook 39 on the end of the rapier will catch this weft and draw it through the shed of the warp. Springs 40 on the back end of each arm 28 serve to return the arm to its position against the stop bar 41 so that all of the arms will be similarly disposed when none of the springs are in stretched position. These springs are anchored on a bar 42 which extends beneath the U frame 26 above mentioned.

As the beatup of the inserted weft occurs, the reed moves this inserted weft to the fell 15 of the fabric 16 and at the same time this weft is inserted into a friction device designated generally 45 adjacent the fell of the fabric. This friction device serves to hold the inserted weft while a cutter 46 severs the weft. This device 45 also serves to hold all of the wefts, there being four shown here, in a position so that anyone of them may be selected by one of the arms 28 for positioning by the arm 37 into the path of the rapier. All of these wefts will be severed and have an end such as at 48 extending on one side of the device 45, and when the rapier engages the selected weft, it will pull this cutoff end of the selected weft out of the device 45 and draw it through the shed formed by the warps where the rapier on its return motion will discharge the inserted weft from its hook 39. This device thus eliminates the necessity of weaving a false selvage along the edge of the cloth.

Figure 2:
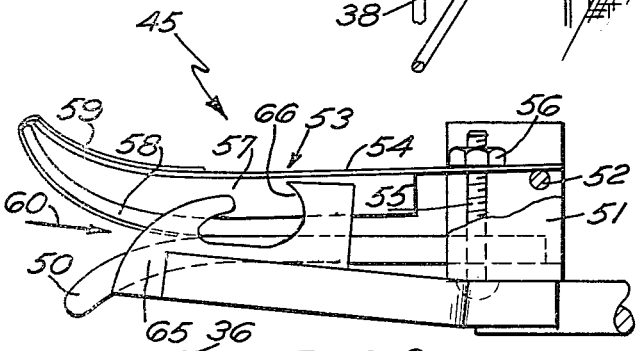
FIG. 2 is a side elevation of the friction holding device for the weft which is used in this invention.
Figure 3:
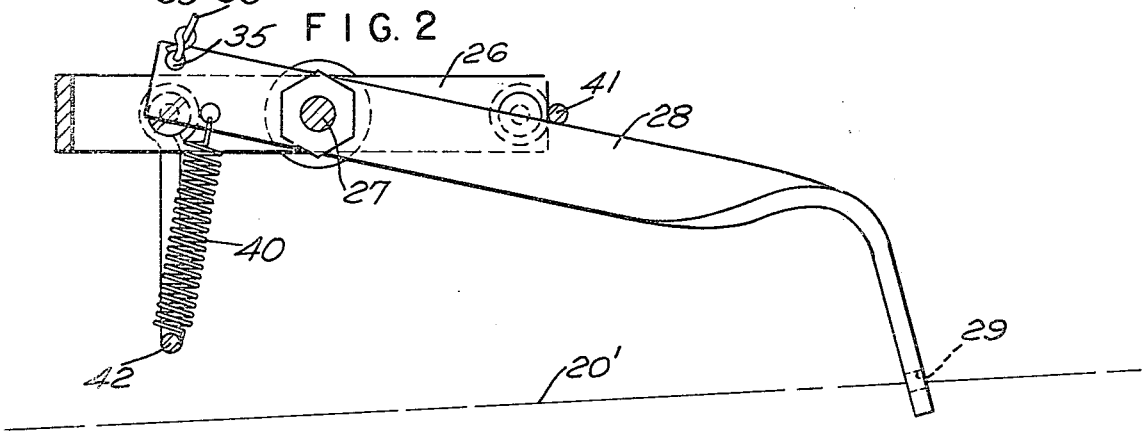
FIG. 3 is a sectional view through the weft selector showing one of the arms of the selector in its position of selecting the weft to be inserted in the shed.

The device 45 has a relatively fixed jaw 50 which is rigidly mounted in a U-frame 51, seen both in FIGS. 1 and 2, and extending between the arms of this U-frame there is a bar 52. The upper or movable jaw of this device is designated generally 53 and comprises a flexible or bendable sheet of material 54 which is drawn down by a threaded member 55 and nut 56 against the bar 52 and, being forward of the bar 52, will exert pressure downwardly on the sheet metal jaw 54 so as to provide the desired pressure needed by reason of the adjustment of the nut 56. Beneath this sheet metal jaw 54 there is a padding of resilient material such as rubber or synthetic rubber 57 which is covered by a flexible sheet of material such as leather 58 and further covered at the tip of this resilient jaw by a thin smooth capping 59 which provides a mouth 60 between the fixed jaw 50 and the spring jaw 53 for the reception of the weft as it is beat up to the fell of the fabric. A bracket 65, having a recess 66 therein, is fixed to the frame 51 and extends therefrom in order to receive the beat up wefts while allowing them to be held between the spring jaw 53 and the relatively fixed jaw 50 of the device. This recess 66 of the bracket is enabled to carry a plurality of wefts and although I have shown four wefts in this illustration, at least twice this number could be held by the device designated generally 45.

It will be apparent that the selected weft may be positioned to be engaged and pulled through the shed of the warp by the rapier 13, then beat up to the fell of the fabric 15, and at the same time positioned through the mouth 60 of the friction holdin-device, and when in this position, the cutter 46 operates to sever the weft leaving the weft held securely by friction in the device 45. If a different weft from a different supply is next to be inserted, then an arm 28 which carries that weft will be swung to a position so that the fork end 37' on the finger 37 may engage it and move it over into the path of the rapier. The selector designated generally 25 may also be positioned so that it is merely necessary to lower the weft into the path of the rapier without the necessity of the finger 37, inasmuch as the rapier operates at a lower position then the normal position of the wefts when not depressed.

I claim:

1. In a loom, a plurality of warps, means to provide a shed of the warps, a plurality of stationary weft supplies, weft insertion means to place a weft in the warp shed, a reed to beat up the weft to the fell of the fabric, a friction holding device comprising a pair of jaws adjacent the fell of the fabric to receive and hold a plurality of the wefts as beat up, means adjacent the holding device comprising a bracket having a thread receiving recess for positioning the weft threads relative to said pair of jaws, means between said device and fell to sever each weft as positioned in said device, means to select and position a weft from said plurality of wefts to be engaged by said weft insertion means in the warp shed.

2. In a loom as in claim 1 wherein said device is stationary and comprises a pair of jaws resiliently urged toward each other to grip and hold a plurality of wefts as inserted between them by the beat up of the reed.

3. In a loom as in claim 2 wherein said jaws open away from each other at their receiving end to provide an entrance mouth to receive said weft.

4. In a loom as in claim 2 wherein the grip by said device on the wefts is such as to permit the weft insertion means to pull a weft from the device as the weft is positioned in the shed.

5. In a loom as in claim 1 wherein said selector means comprises a plurality of pivoted levers each guiding a weft and means to swing a selected lever to position its weft for pickup by said weft insertion means.

6. In a loom as in claim 1 wherein the weft inserting means is a hook to pull the weft through the shed.

* * * * *